US009534854B2

(12) United States Patent
Romlund

(10) Patent No.: US 9,534,854 B2
(45) Date of Patent: Jan. 3, 2017

(54) HEAT EXCHANGER PLATE AND A PLATE HEAT EXCHANGER

(75) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 513 days.

(21) Appl. No.: 13/805,893

(22) PCT Filed: Sep. 6, 2010

(86) PCT No.: PCT/SE2010/050946

§ 371 (c)(1),
(2), (4) Date: Feb. 4, 2013

(87) PCT Pub. No.: WO2011/162659

PCT Pub. Date: Dec. 29, 2011

(65) Prior Publication Data

US 2013/0126135 A1 May 23, 2013

(30) Foreign Application Priority Data

Jun. 24, 2010 (SE) ..... 1050690

(51) Int. Cl.
*F28F 3/00* (2006.01)
*F28F 3/08* (2006.01)
(Continued)

(52) U.S. Cl.
CPC ..... *F28F 13/18* (2013.01); *F28D 9/005* (2013.01); *F28F 3/046* (2013.01); *F28F 3/08* (2013.01)

(58) Field of Classification Search
CPC ..... F28F 3/046; F28F 3/0486; F28F 3/086; F28F 2275/04; F28D 9/005; F28D 9/0037; F28D 9/0043; B23K 1/0012
(Continued)

(56) References Cited

U.S. PATENT DOCUMENTS 1,902,320 A * 3/1933 Burton ..... 165/148
3,476,179 A 11/1969 Meister et al.
(Continued)

FOREIGN PATENT DOCUMENTS

CN 2573986 Y 9/2003
EP 1 850 082 A1 4/2006
(Continued)

OTHER PUBLICATIONS

Office Action (Notice of Allowance) issued on Feb. 13, 2014, by the Russian Federal Service for Intellectual Property, in corresponding Russian Patent Application No. 2013103115. (5 pages).
(Continued)

*Primary Examiner* — Allen Flanigan
*Assistant Examiner* — Jason Thompson
(74) *Attorney, Agent, or Firm* — Buchanan Ingersoll & Rooney PC

(57) ABSTRACT

A plate heat exchanger includes several heat exchanger plates provided beside each other, which form first and second alternating plate interspaces. Every second heat exchanger plate forms a primary plate and every second secondary plate. Each heat exchanger plate extends in an extension plane and includes a heat transfer area and an edge area around the heat transfer area. The heat transfer area includes a corrugation of longitudinally extending ridges and valleys. The ridges have two edge surfaces and a support surface between the edge surfaces, with a first width transversally to the longitudinal direction. The valleys have two edge surfaces and a support surface between the edge surfaces, with a second width transversally to the longitudinal direction. The support surface of valleys of the primary plates slopes relative to the extension plane and the support surface of ridges of the secondary plates slopes relative to the extension plane.

21 Claims, 3 Drawing Sheets

(51) Int. Cl.
*F28F 13/18* (2006.01)
*F28D 9/00* (2006.01)
*F28F 3/04* (2006.01)

(58) Field of Classification Search
USPC ..... 165/166, 167
See application file for complete search history.

(56) References Cited

U.S. PATENT DOCUMENTS

| | | | | |
|---|---|---|---|---|
| 4,423,772 | A | 1/1984 | Dahlgren | |
| 4,605,050 | A | 8/1986 | Suk | |
| 4,605,060 | A | 8/1986 | Andersson et al. | |
| 5,806,584 | A | 9/1998 | Thonon et al. | |
| 5,971,065 | A * | 10/1999 | Bertilson et al. | 165/166 |
| 6,164,372 | A | 12/2000 | Persson | |
| 6,237,679 | B1 | 5/2001 | Vestergren | |
| 6,394,179 | B1 * | 5/2002 | Blomgren et al. | 165/167 |
| 6,904,961 | B2 * | 6/2005 | Ayres | 165/133 |
| 7,246,436 | B2 | 7/2007 | Blomgren et al. | |
| 7,426,957 | B2 * | 9/2008 | Hendrix | F28D 9/005 165/166 |
| 8,596,343 | B2 | 12/2013 | Christensen et al. | |
| 8,939,195 | B2 * | 1/2015 | Krantz et al. | 165/79 |
| 2005/0189097 | A1 * | 9/2005 | Fowser | F23L 15/00 165/166 |
| 2005/0194123 | A1 | 9/2005 | Strahle et al. | |
| 2008/0029257 | A1 | 2/2008 | Nilsson | |
| 2008/0257536 | A1 | 10/2008 | Kolblin et al. | |
| 2008/0264618 | A1 | 10/2008 | Richter | |
| 2009/0159251 | A1 | 6/2009 | Blomgren | |
| 2011/0209861 | A1 * | 9/2011 | Hayashi et al. | 165/185 |
| 2011/0220334 | A1 * | 9/2011 | Olsson et al. | 165/167 |

FOREIGN PATENT DOCUMENTS

| | | | |
|---|---|---|---|
| FR | 1 542 920 | A | 10/1968 |
| GB | 1 162 654 | A | 8/1969 |
| GB | 1 468 514 | A | 3/1977 |
| JP | 62-22787 | U | 2/1987 |
| JP | 01-181092 | A | 7/1989 |
| JP | H02-33959 | B2 | 7/1990 |
| JP | H05-45477 | U | 6/1993 |
| JP | 05-280883 | A | 10/1993 |
| JP | 2753298 | B2 | 5/1998 |
| JP | 10-205039 | A | 8/1998 |
| JP | 11-173771 | A | 7/1999 |
| JP | 11-281283 | A | 10/1999 |
| JP | 11-281284 | A | 10/1999 |
| JP | 2000-097590 | A | 4/2000 |
| JP | 2000-193390 | A | 7/2000 |
| JP | 2001-194086 | A | 7/2001 |
| JP | 2005-514576 | A | 5/2005 |
| JP | 2008-511811 | A | 4/2008 |
| JP | 2009-540257 | A | 11/2009 |
| KR | 10-2007-0048707 | A | 5/2007 |
| RU | 59 230 | U1 | 12/2006 |
| SE | 458 718 | B | 4/1989 |
| SE | 458718 | B | 4/1989 |
| SU | 473044 | A2 | 6/1975 |
| WO | 83/01998 | A1 | 6/1983 |
| WO | 88/08508 | A1 | 11/1988 |
| WO | 99/24772 | A1 | 5/1999 |
| WO | WO 99/24772 | A1 | 5/1999 |
| WO | 01/16544 | A1 | 3/2001 |
| WO | 2006/024340 | A1 | 3/2006 |
| WO | 2007/142592 | A1 | 12/2007 |
| WO | 2008/128235 | A1 | 10/2008 |
| WO | WO 2008/128235 | A1 | 10/2008 |
| WO | 2009/080565 | A1 | 7/2009 |
| WO | 2009/123517 | A1 | 10/2009 |
| WO | 2010/056183 | A2 | 5/2010 |

OTHER PUBLICATIONS

An English Translation of the First Office Action issued on May 13, 2014, by the State Intellectual Property Office, P.R. China in corresponding Chinese Patent Application No. 201080067686.6. (8 pages).

International Search Report (PCT/ISA/210) issued on Sep. 6, 2011, by the Swedish Patent Office as the International Searching Authority for International Application No. PCT/SE2010/050946.

Notification Concerning Transmittal of International Preliminary Report on Patentability (Forms PCT/IB/326 and PCT/IB/373) and the Written Opinion of the International Searching Authority (Form PCT/ISA/237) Issue on Jan. 10, 2013, in the corresponding International Application No. PCT/SE2010/050946. (5 pages).

An English Translation of the Office Action (First Office Action) issued on Dec. 10, 2013, by the Japanese Patent Office in corresponding Japanese Patent Application No. 2013-516522. (5 pages).

An English Translation of the Office Action (Grounds of the Preliminary Examination Report) issued on Jan. 10, 2014, by the Taiwanese Patent Office in corresponding Taiwanese Patent Application No. 100116815. (7 pages).

An English Translation of the Office Action (Notice of Preliminary Rejection) issued Feb. 14, 2014, by the Korean Patent Office in corresponding Korean Patent Application No. 10-2012-7033407. (4 pages).

* cited by examiner

HEAT EXCHANGER PLATE AND A PLATE HEAT EXCHANGER

The present invention refers to a heat exchanger plate according to the preamble of claim 1. The invention also refers to a plate heat exchanger according to the preamble of claim 6. Such a plate heat exchanger is disclosed in U.S. Pat. No. 4,423,772.

This invention refers especially, but not exclusively, to so-called asymmetrical plate heat exchangers. In an asymmetrical plate heat exchanger, the flow area or flow volume for the first medium in the first plate interspaces differs from the flow area or flow volume for the second medium in the second plate interspaces, see also SE-B-458 718 and the above-mentioned U.S. Pat. No. 4,423,772.

Such asymmetrical plate heat exchangers are interesting in various applications where the media have different properties. One example of such an application is in cooling circuits, for instance heat pumps where the cooling medium have other properties than the medium, for instance water, to be heated. The cooling medium operates within certain specific temperature and pressure ranges.

Many heat exchanger plates, especially in asymmetrical plate heat exchangers, have a corrugation with ridges and/or valleys with wide support surfaces. One problem with such support surfaces is that the contact points between the heat exchanger plates form relatively large contact areas. In brazed plate heat exchangers, the braze material will flow out in the whole contact area. In these contact areas there is no direct heat transfer since the medium on one side of the contact area is in heat exchanging contact with the same medium on the other side of the contact area. The contact areas thus create a kind of short circuit. This becomes a problem if the contact areas are too large.

SUMMARY OF THE INVENTION

The object of the present invention is to provide a heat exchanger plate and a plate heat exchanger, which contribute to reducing the size of the contact points or contact areas. Especially, it is aimed at a reduction of the size of the contact areas in asymmetrical plate heat exchangers.

This object is achieved by the initially defined heat exchanger plate, which is characterized in that the support surface of the valleys slopes in relation to the extension plane. Since the support surface of the valleys slopes, the contact point formed with a corresponding heat exchanger plate will form a small contact area in relation to when the support surface is parallel with the extension plane.

According to an embodiment of the invention, the second width is longer than the first width, i.e. the support surface of the valleys is wider than the support surface of the ridges, which enables achievement of asymmetrical plate heat exchangers. The size of the contact area at the relatively wide support surfaces of the valleys may through the defined inclination be reduced in an elegant manner.

According to a further embodiment of the invention, the first width approaches zero, i.e. the support surface of the ridges approaches zero and may be formed by a rounding. Such a rounding may have a radius of curvature which then is relatively short.

According to a further embodiment of the invention, the support surface of the valleys is substantially plane. However, it is to be noted that the support surface may have a certain curvature, concave or convex, but still an inclination from one of the edge surfaces to the other of the edge surfaces.

According to a further embodiment of the invention, the support surface of the valleys slopes in relation to the extension plane with an angle of inclination that is 3-15°, preferably 3-7°.

The object is also achieved by the initially defined plate heat exchanger, which is characterized in that the support surface of the valleys of the primary plates slopes in relation to the extension plane and that the support surface of the ridges of the secondary plates slopes in relation to the extension plane.

Since the support surface of the valleys of the primary plates and the support surface of the ridges of the secondary plates slope, the contact point which is formed between these support surfaces of the primary plates and the secondary plates will form a small contact area in comparison with when these support surfaces are parallel with the extension plane.

According to an embodiment of the invention, the second width of the primary plates is longer than the first width of the primary plates, wherein the first width of the secondary plates is longer than the second width of the secondary plates. With such a configuration of the ridges and the valleys of the primary plates and the secondary plates an asymmetrical plate heat exchanger is achieved.

According to a further embodiment of the invention, the first width of the primary plates and the second width of the secondary plates approach zero. This means that the support surface of the ridges of the primary plates and the support surface of the valleys of the secondary plates approach zero and may be formed by a rounding. Such a rounding may have a radius of curvature which then is relatively short.

According to a further embodiment of the invention, the support surface of the valleys of the primary plates and the support surface of the ridges of the secondary plates are substantially plane. It is to be noted that these support surfaces may have a certain curvature, concave or convex, but still an inclination from one of the edge surfaces to the other edge surface.

According to a further embodiment the support surface of the valleys of the primary plates and the support surface of the ridges of the secondary plates slope in relation to the extension plane with an angle of inclination that is 3-15°, preferably 3-7°. Such an angle is advantageous for efficient reduction of the size of the contact areas, and at the same time a sufficient asymmetry of the plate heat exchanger is enabled.

According to a further embodiment of the invention, the support surface of the valleys of one of the primary plates and the support surface of the ridges of one of the secondary plates abut each other, wherein this primary plate and this secondary plate enclose one of the first plate interspaces with a first flow volume, at the same time as the support surface of the ridges of one of the primary plates and the support surface of the valleys of one of the secondary plates abut each other, wherein this primary plate and this secondary plate enclose one of the second plate interspaces with a second flow volume, wherein the quotient between the first flow volume and the second flow volume is between 1.2 and 3, preferably between 1.5 and 2.5 and more preferably between 1.8 and 2.1.

According to a further embodiment of the invention, the primary plates and the secondary plates are formed by differently shaped heat exchanger plates. Such a design is especially advantageous for brazed, or in any other way permanently connected, heat exchanger plates which possibly may have an outer flange extending around the whole or a part of the heat exchanger plate away from the extension plane. The primary plates and the secondary plates are here manufactured separately, wherein the support surfaces of the ridges of the primary plates has a smaller width than the support surface of the ridges of the secondary plates.

According to a further embodiment of the invention, the primary plates and the secondary plates are identical, wherein every second heat exchanger plate in the plate package is rotated 180° in such a way that the support surface of the ridges of every second heat exchanger plate abuts and crosses the support surface of the ridges of the intermediate heat exchanger plates and wherein the heat exchanger plates are pressed against each other by means of tie members. The invention is advantageous also for this kind of plate heat exchangers when the pressing of the heat exchanger plates against each other leads to a certain deformation of the contact points so that these form a contact area. With the inventive design and the inclination of the support surfaces of the valleys of the primary plates and of the ridges of the secondary plates, the size of the contact areas will be reduced in relation to if the support surfaces have had an extension in parallel with the extension plane.

According to a further embodiment of the invention each heat exchanger plate has a first end and a second opposite end with regard to the centre axis, wherein the first edge surfaces of the primary plates and the secondary plates are turned towards the first end whereas the second edge surfaces of the primary plates and the secondary plates are turned towards the second end.

According to an advantageous variant of this embodiment, the support surface of the valleys of the primary plates slopes from the first edge surfaces in a direction towards the extension plane and towards the second edge surfaces at the same time as the support surface of the ridges of the secondary plates slopes from the first edge surfaces in a direction towards the extension plane and towards the second edge surfaces. If the heat exchanger plates are arranged in this way, the flow resistance in the first plate interspaces will be relatively small in one flow direction but relatively large in a second opposite flow direction.

According to a second variant of this embodiment, the support surface of the valleys of the primary plates slopes from the first edge surfaces in a direction towards the extension plane and towards the second end surfaces at the same time as the support surface of the ridges of the secondary plates slopes from the second edge surfaces in a direction towards the extension plane and towards the first edge surfaces. In this variant the flow resistance in the first plate interspaces is substantially equal in both flow directions.

BRIEF DESCRIPTION OF THE DRAWINGS

The present invention is now to be explained more closely through a description of various embodiments with reference to the drawings attached hereto.

DETAILED DESCRIPTION OF VARIOUS EMBODIMENTS OF THE INVENTION

Figure 1:
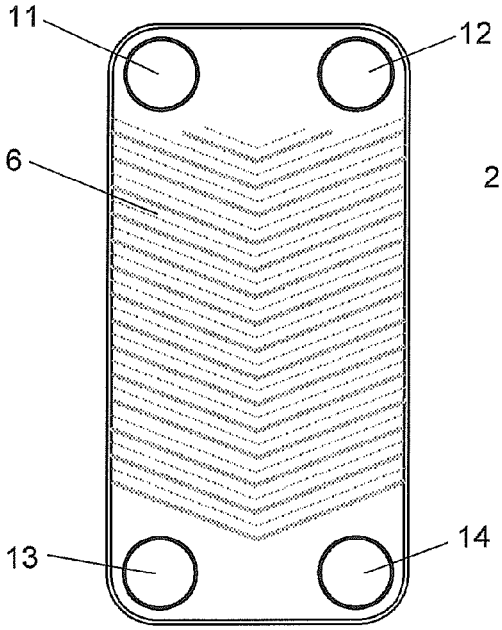
FIG. 1 discloses schematically a front view of a plate heat exchanger according to a first embodiment of the invention.

With reference to the figures attached, a plate heat exchanger is disclosed, see FIGS. 1 and 2, and 3 and 4, respectively. The plate heat exchanger comprises a plurality of heat exchanger plates 1 which are provided beside each other for forming a plate package 2 with first plate interspaces 3 for a first medium and second plate interspaces 4 for a second medium. The first plate interspaces 3 and the second plate interspaces 4 are provided in an alternating order in the plate package 2, i.e. every second plate interspace is a first plate interspace 3 and every remaining plate interspace is a second plate interspace 4, see FIG. 8.

Figure 2:
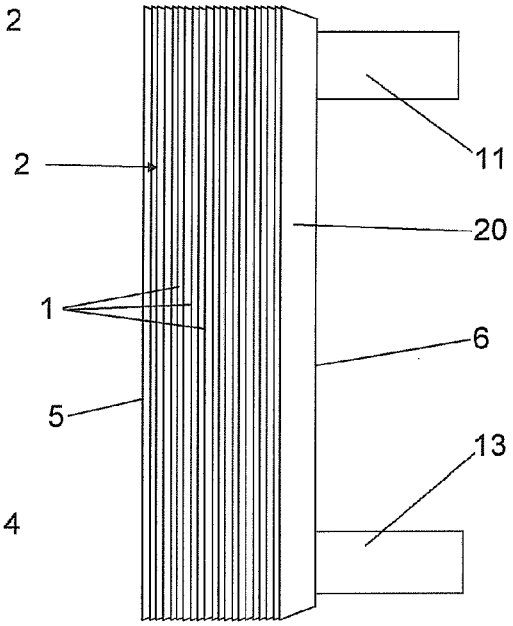
FIG. 2 discloses schematically a side view of the plate heat exchanger in FIG. 1.

The plate heat exchanger disclosed in FIGS. 1 and 2 has heat exchanger plates 1 which are permanently joined to each other, preferably through brazing. The heat exchanger plates 1 may also be permanently joined to each other through gluing or welding. The two outermost heat exchanger plates may form or be replaced by end plates 5 and 6.

Figure 3:
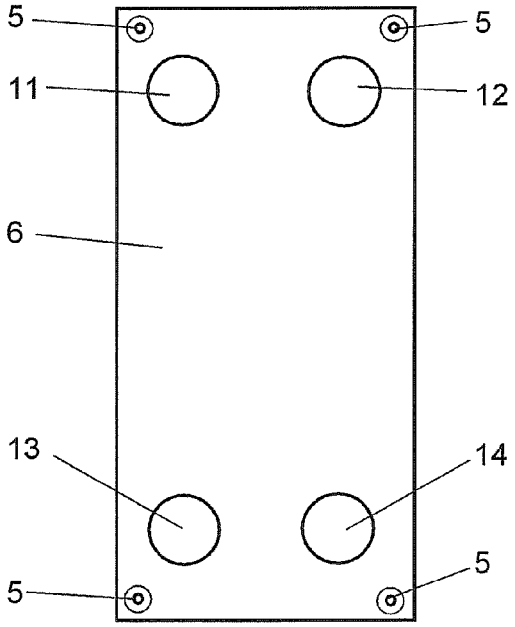
FIG. 3 discloses schematically a front view of a plate heat exchanger according to a second embodiment of the invention.
Figure 4:
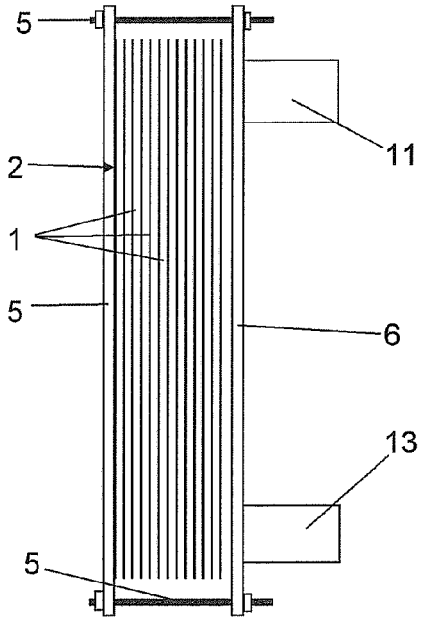
FIG. 4 discloses schematically a side view of the plate heat exchanger in FIG. 3.

In the plate heat exchanger disclosed in FIGS. 3 and 4, the heat exchanger plates are pressed against each other to the plate package by means of tie members 5, which are designed as tie bolts extending through the two end plates 6 and 7, between which the heat exchanger plates 1 are provided.

The plate heat exchanger also comprises inlet and outlet channels 11-14, which are arranged to convey the first medium into the first plate interspaces 3 and out from the same, and to convey the second medium into the second plate interspaces 4 and out from the same.

The heat exchanger plates 1, which are now to be described more closely, refer to heat exchanger plates 1 for plate heat exchangers according to the first embodiment disclosed in FIGS. 1 and 2. Each heat exchanger plate 1 extends in an extension plane, or a main extension plane p, see FIG. 8, and comprises a heat transfer area 15 and an edge area 16 extending around the heat transfer area 15. The extension plane p also forms a mid plane for each heat exchanger plate, at least with regard to the heat transfer area 15. Each heat exchanger plate 1 also comprises two porthole areas 17 and 18, which are provided at a first end 1A of the heat exchanger plate 1 and at a second end 1B of the heat exchanger plate 1, respectively. The porthole areas 17 and 18 are located inside the edge area 16, and more specifically between the edge area 16 and the heat transfer area 15. Each porthole area 17, 18 comprises two portholes 19 which are aligned with respective inlet and outlet channels 11-14. Each heat exchanger plate 1 also comprises a surrounding outer flange 20 extending away from the extension plane p, see FIG. 1. The flange 20 is provided outside or forms an outer part of the edge area 16. It is to be noted that the heat exchanger plates 1 according to the first embodiment also may lack such an outer flange 20 or have an outer flange which extends along a part of the periphery of the heat exchanger plate 1.

In the embodiments disclosed, each heat exchanger plate 1 has an elongated shape from the first end 1A to the second end 1B. Each heat exchanger plate 1 thus defines a longitudinal centre axis×lying in the extension plane p and extending through the first end 1A and the second end 1B. More precisely, the centre axis×lies between the two portholes 19 of the first porthole area 17 and between the portholes 19 of the second porthole area 18.

Figure 5:
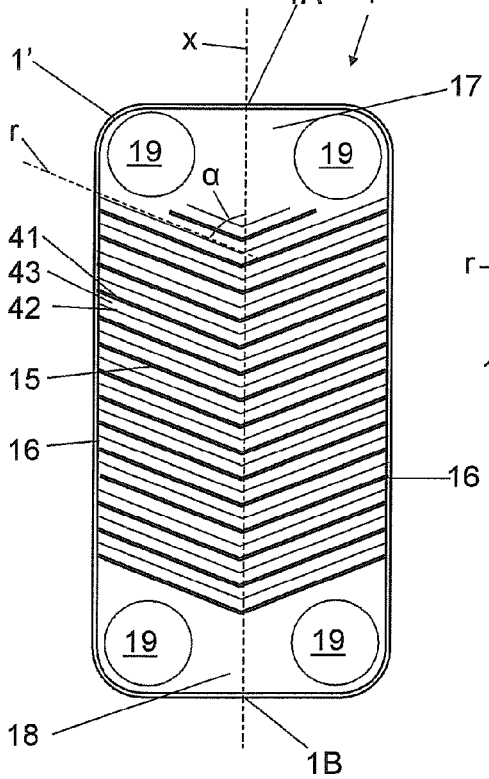
FIG. 5 discloses schematically a plan view of a heat exchanger plate in the form of a primary plate of the plate heat exchanger in FIG. 1.

The heat transfer area 15 comprises a corrugation of ridges 30 and valleys 40, which each extends in a longitudinal direction r which in the embodiments disclosed forms an angle α, see FIG. 5. The angle α may be between 25 and 70°, preferably between 45 and 65°, especially approximately 60°. In the embodiments disclosed, the corrugation is designed as an arrow pattern. It is to be noted, however, that other patterns are possible within the scope of the invention, for instance a corrugation with ridges 30 and valleys 40 extending diagonally across the whole heat transfer area 15.

Figure 8:
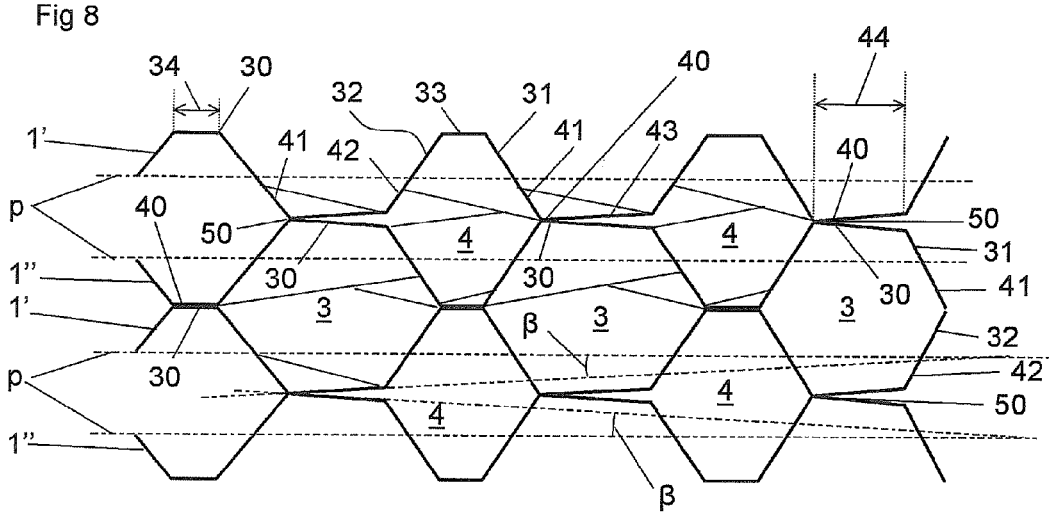
FIG. 8 discloses schematically a cross section through four of the heat exchanger plates in the plate heat exchanger in FIGS. 1-4.

As can be seen in FIG. 8, the ridges 30 has a first edge surface 31, a second edge surface 32 and a support surface 33 which extends between the first edge surface 31 and the second edge surface 32. The ridges 30 have a first width 34 transversally to the longitudinal direction r. Also the valleys have a first edge surface 41, a second edge surface 42 and a support surface 43, which extends between the first edge surface and the second edge surface 42. The support surface 43 of the valleys has a second width 44 transversally to the longitudinal direction r. As can be seen in FIG. 8, the first edge surface 31 of the ridges 30 continues to the first edge surface 41 of the valleys 40. These first edge surfaces 31 and 41 are separated at the extension plane p. In the same way the second edge surface 32 of the ridges 30 continues into the second edge surface 42 of the valleys 40 and are separated by the extension plane p.

In FIG. 8, the borders between the support surfaces 33; 43 and the edge surfaces 31, 32; 41, 42, are relatively sharp. However, it is to be noted that both of these or one of them may be rounded.

Figure 6:
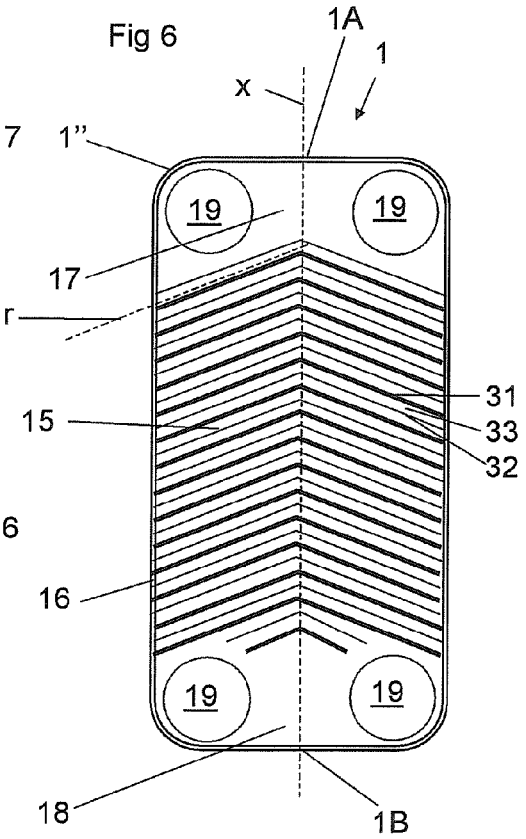
FIG. 6 discloses schematically a plane view of a heat exchanger plate in the form of a secondary plate of the plate heat exchanger in FIG. 1.
Figure 7:
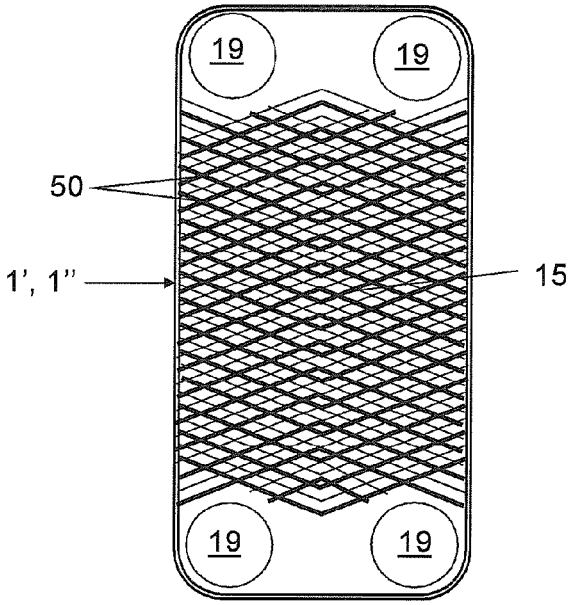
FIG. 7 discloses schematically a view of the primary plate in FIG. 5 and the secondary plate in FIG. 6 provided on each other.

As can be seen in FIGS. 5-8, the heat exchanger plates 1 in the plate package 2 comprise or form primary plates 1', see FIG. 5, and secondary plates 1", see FIG. 6. These are arranged in such a way that every second heat exchanger plate 1 in a plate package forms a primary plate 1' and every second heat exchanger plate 1 provided there between forms a secondary plate 1" see FIGS. 7 and 8.

The second width 44, i.e. the width of the support surface 43, of the primary plate 1' is longer, or significantly longer, than the first width 34, i.e. the width of the support surfaces 33, of the primary plates 1'. In the same way, the first width 34, i.e. the width of the support surfaces 33, of the secondary plate 1" is longer than, or significantly longer, than the second width 44, i.e. the width of the support surfaces 43, of the secondary plates 1". More specifically, the first width 34 of the primary plates 1' may approach zero as well as the second width 44 of the secondary plates 1". In such a way, an asymmetrical plate heat exchanger is achieved, where the flow area, or the flow volume, of the second plate interspaces 4 is larger than the flow area, or flow volume, of the first plate interspaces 3.

This asymmetry is illustrated in FIG. 8 where it can be seen that the first plate interspaces 3 have a larger flow area, or flow volume, than the second plate interspaces 4. Furthermore, as can be seen in FIG. 8, the support surface 43 of the valleys 40 of one of the primary plates 1' and the support surface 33 of the ridges 30 of one of the secondary plates 1" abut each other. This primary plate 1' and this secondary plate 1" enclose one of the first plate interspaces 3 which thus has the first flow volume. In the same way the support surface 33 of the ridges 30 of one of the primary plates 1' abut the support surface 43 of the valleys 40 of one of the secondary plates 1". This primary plate 1' and this secondary plate 1" enclose one of the second plate interspaces 4 which thus has the second flow volume. The quotient between the first flow volume and the second flow volume is between 1.2 and 3, preferably between 1.5 and 2.5 and more preferably between 1.8 and 2.1.

As also can be seen in FIG. 8, the support surface 43 of the valleys 40 of the primary plates 1' slopes in relation to the extension plane p. In the same way the support surface 33 of the ridges 30 of the secondary plates 1" slopes in relation to the extension plane p. This sloping means that the above-mentioned abutment between the support surfaces 43 and 33 will extend over a relatively small contact area 50, in particular in comparison with if the support surfaces 43 and 33 had had an extension in parallel with the extension plane p. These support surfaces 33 and 43 slope with an angle β of inclination in relation to the extension plane p. The angle β of inclination is 3-15°, preferably 3-7°, for instance 5° or approximately 5°.

Figure 9:
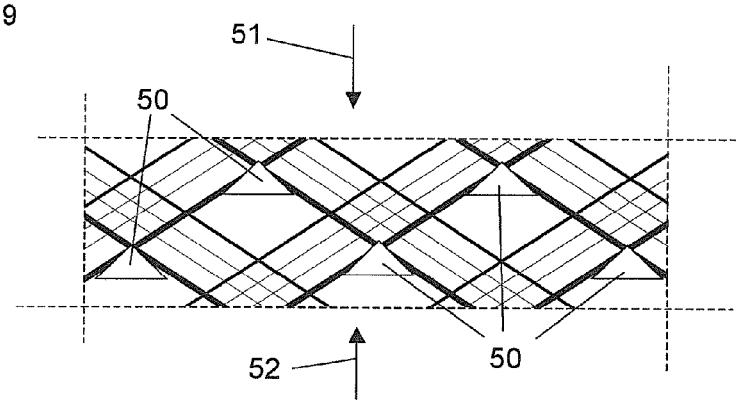
FIG. 9 discloses schematically a view of the pattern of a primary plate and a secondary plate according to a first variant.

As also is illustrated in FIG. 8, the support surfaces 33 and 43 are substantially plane. However, it is to be noted that these surfaces do not need to be plane but may have a curved or in any other way irregular shape within an overall inclination from one of the edge surfaces 41, 42, and 31, 32, respectively, to the other of the edge surfaces 41, 42, and 31, 32, respectively. The inclination of the support surfaces 33 and 43 may be arranged in various ways in the primary plates 1' and the secondary plates 1". FIGS. 5-8 disclose how the first edge surfaces 31, 41 of the primary plates 1' and the secondary plates 1" are turned towards the first end 1A whereas the second edge surfaces 32, 42 of the primary plates 1' and the secondary plates 1" are turned towards the second end 1B. The support surface 43 of the valleys 40 of the primary plates 1' slopes from the first edge surfaces 41 in a direction towards the extension plane p and towards the second edge surfaces 42 of the valleys 40 of the primary plates 1'. The support surface 33 of the ridges 30 of the secondary plates 1" slopes from the first edge surfaces 31 in a direction towards the extension plane p and towards the second edge surfaces 32 of the ridges 30 of the secondary plates 1". With such an inclination in the same direction, contact areas 50 with the appearance illustrated in FIG. 9 are achieved. The contact area 50 has a triangular shape and will contribute to a lower flow resistance when the flow is in the direction of the arrow 51 in comparison with if the flow is in the opposite direction, i.e. in the direction of the arrow 52.

Figure 10:
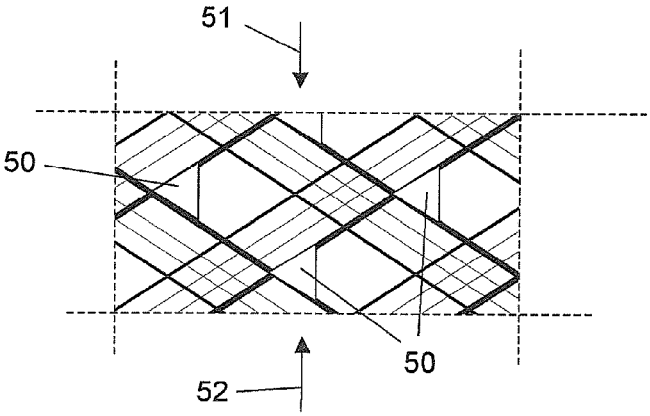
FIG. 10 discloses schematically a view of the pattern of a primary plate and a secondary plate according to a second variant.

It is also possible to let the support surfaces slope in different directions, wherein the support surface 43 of the valleys 40 of the primary plates 1' slopes from the first edge surfaces 41 in a direction towards the extension plane p and towards the second edge surfaces 42 of the valleys 40 of the primary plates 1' and wherein the support surface 33 of the ridges 30 of the secondary plates 1" slopes from the edge surfaces 32 in a direction towards the extension plane p and towards the first edge surfaces 31 of the ridges 30 of the secondary plates 31'. With such an inclination of the support surfaces 33, 43, contact areas 50 with the appearance illustrated in FIG. 10 are achieved. Also in this case a triangularlike shape of the contact areas 50 is obtained, but the flow resistance in the opposite directions 51 and 52 is substantially equal.

Within the contact areas 50, the heat exchanger plates 1 will be in contact with each other. In the illustrated embodiment with a brazed plate heat exchanger, the contact areas 50 will be formed, or substantially formed, by braze material.

In the embodiment disclosed, the primary plates 1' and the secondary plates 1" are formed by differently shaped heat exchanger plates which are separately manufactured, wherein each heat exchanger plate 1 has a surrounding flange 20 extending in one direction from the extension plane p. The primary plates 1' then have a arrow pattern in the heat transfer area 15 according to FIG. 5 whereas the secondary plates 1" have an arrow pattern in the heat transfer area 15 directed in an opposite direction in accordance with FIG. 6.

In the case that the heat exchanger plates do not have any surrounding flange, the primary plates 1' and the secondary plates 1" may be identical. In this case, the primary plate 1' and the secondary plate 1" are provided by letting every second heat exchanger plate, for instance the secondary plates 1", be rotated 180° in the extension plane p. In such a way the heat transfer area 15 of the primary plates 1' will have a corrugation with an arrow pattern according to FIG. 5 and the heat transfer area 15 of the secondary plates 1" an arrow pattern of the corrugation according to FIG. 6. Such identical heat exchanger plates 1 may advantageously be used in plate heat exchangers where the heat exchanger plates 1 are pressed against each other by means of tie members 5, see FIGS. 3 and 4.

The invention is not limited to the embodiments disclosed but may be varied and modified within the scope of the following claims.

The invention claimed is:

1. A heat exchanger plate for a plate heat exchanger with a plurality of heat exchanger plates provided beside each other for forming first plate interspaces for a first medium and second plate interspaces for a second medium, wherein the heat exchanger plate extends in a main extension plane along a centre axis and comprises a heat transfer area and an edge area which extends around the heat transfer area, wherein the heat transfer area comprises a corrugation of ridges and valleys, which each extends in a longitudinal direction, wherein the ridges has a first edge surface, a second edge surface and a support surface, which extends between the first and second edge surfaces and has a first width transversally to the longitudinal direction, wherein the valleys has a first edge surface, a second edge surface and a support surface, which extends between the first and second edge surfaces and has a second width transversally to the longitudinal direction, wherein the support surface of the valleys slopes from the first edge surface of the valley to the second edge surface of the valley in relation to the extension plane at an inclination angle other than zero degrees, wherein the first edge surface of the ridge and the second edge surface of the ridge slope continuously upward from the main extension plane, and wherein the first edge surface of the valley and the second edge surface of the valley slope continuously downward from the main extension plane.

2. A heat exchanger plate according to claim 1, wherein the second width is longer than the first width.

3. A heat exchanger plate according to claim 2, wherein the first width is greater than zero.

4. A heat exchanger plate according to claim 1, wherein the support surface of the valleys is planar.

5. A heat exchanger plate according to claim 1, wherein the support surface of the valleys slopes in relation to the extension plane with an angle of inclination that is 3-15°.

6. A plate heat exchanger comprising a plurality of heat exchanger plates provided beside each other for forming a plate package with first plate interspaces for a first medium and second plate interspaces for a second medium, wherein the first and second plate interspaces are provided in an alternating order in the plate package, wherein every second heat exchanger plate in the plate package forms a primary plate and every remaining heat exchanger plate provided there between forms a secondary plate, wherein each heat exchanger plate extends in a main extension plane along a centre axis and comprises a heat transfer area and an edge area which extends around the heat transfer area, wherein the heat transfer area comprises a corrugation of ridges and valleys, which each extends in a longitudinal direction, wherein the ridges has a first edge surface, a second edge surface and a support surface, which extends between the first and second edge surfaces and has a first width transversally to the longitudinal direction, wherein the valleys has a first edge surface, a second edge surface and a support surface, which extends between the first and second edge surfaces and has a second width transversally to the longitudinal direction, wherein the support surface of the valleys of the primary plates slopes at a first inclination angle, from the first edge surface of the valley to the second edge surface of the valley, in relation to the extension plane, and the support surface of the ridges of the secondary plates slopes at a second inclination angle, from the first edge surface of the ridge to the second edge surface of the ridge, in relation to the extension plane, the first inclination angle and the second inclination angle being angles other than zero degrees, wherein the first edge surfaces of the ridges and the second edge surfaces of the ridges slope upward from the extension plane along their entire extent, and wherein the first edge surfaces of the valleys and the second edge surfaces of the valleys slope downward from the extension plane along their entire extent.

7. A plate heat exchanger according to claim 6, wherein the second width of the primary plates is longer than the first width of the primary plates and wherein the first width of the secondary plates is longer than the second width of the secondary plates.

8. A plate heat exchanger according to claim 7, wherein the first width of the primary plates is greater than zero and wherein the second width of the secondary plates is greater than zero.

9. A plate heat exchanger according to claim 6, wherein the support surface of the valleys of the primary plates is planar and the support surface of the ridges of the secondary plates is planar.

10. A plate heat exchanger according to claim 6, wherein the support surface of the valleys of the primary plates and the support surface of the ridges of the secondary plates slope in relation to the extension plane with an angle of inclination that is 3-15°.

11. A plate heat exchanger according to claim 6, wherein the support surface of the valleys of one of the primary plates and the support surface of the ridges of one of the secondary plates abut each other, wherein the one primary plate and the one secondary plate enclose one of the first plate interspaces with a first flow volume, the support surface of the ridges of the one of the primary plates and the support surface of the valleys of another one of the secondary plates abut each other, wherein the one primary plate and the another one secondary plate enclose one of the second plate interspaces with a second flow volume, and the quotient between the first flow volume and the second flow volume is between 1.2 and 3.

12. A plate heat exchanger according to claim 6, wherein the primary plates and the secondary plates are differently shaped heat exchanger plates.

13. A plate heat exchanger according to claim 12, wherein each heat exchanger plate has a surrounding flange extending away from the extension plane.

14. A plate heat exchanger according to claim 12, wherein the heat exchanger plates are permanently connected to each other, for instance through brazing.

15. A plate heat exchanger according to claim 6, wherein the primary plates and the secondary plates are identical, wherein every second heat exchanger plate in the plate package is rotated 180° in such a way that the support surface of the ridges of every second heat exchanger plate abuts and crosses the support surface of the ridges of the intermediate heat exchanger plates and wherein the heat exchanger plates are pressed against each other by means of tie members.

16. A plate heat exchanger according to claim 6, wherein every second heat exchanger plate has a first end and a second opposite end with regard to the centre axis, the first edge surfaces of the primary plates and the secondary plates are turned towards the first end whereas the second edge surfaces of the primary plates and the secondary plates are turned towards the second end, the support surface of the valleys of the primary plates slopes from the first edge surfaces in a direction towards the extension plane and towards the second edge surfaces, and the support surface of the ridges of the secondary plates slopes from the first edge surfaces in a direction towards the extension plane and towards the second edge surfaces.

17. A plate heat exchanger according to claim 6, wherein every heat exchanger plate has a first end and a second opposite end with regard to the centre axis, the first edge surfaces of the primary plates and the secondary plates are turned towards the first end whereas the second edge surfaces of the primary plates and the secondary plates are turned towards the second end, the support surface of the valleys of the primary plates slopes from the first edge surfaces in a direction towards the extension plane and towards the second end surfaces, and the support surface of the ridges of the secondary plates slopes from the second edge surfaces in a direction towards the extension plane and towards the first edge surfaces.

18. A heat exchanger plate according to claim 1, wherein the support surface of the valleys slopes in relation to the extension plane with an angle of inclination that is 3-7°.

19. A plate heat exchanger according to claim 6, wherein the support surface of the valleys of the primary plates and the support surface of the ridges of the secondary plates slope in relation to the extension plane with an angle of inclination that is 3-7°.

20. A plate heat exchanger according to claim 6, wherein the support surface of the valleys of one of the primary plates and the support surface of the ridges of one of the secondary plates abut each other, wherein the one primary plate and the one secondary plate enclose one of the first plate interspaces with a first flow volume, the support surface of the ridges of the one of the primary plates and the support surface of the valleys of another one of the secondary plates abut each other, wherein the one primary plate and the another one secondary plate enclose one of the second plate interspaces with a second flow volume, and the quotient between the first flow volume and the second flow volume is between 1.5 and 2.5.

21. A plate heat exchanger according to claim 6, wherein the support surface of the valleys of one of the primary plates and the support surface of the ridges of one of the secondary plates abut each other, wherein the one primary plate and the one secondary plate enclose one of the first plate interspaces with a first flow volume, the support surface of the ridges of the one of the primary plates and the support surface of the valleys of another one of the secondary plates abut each other, wherein the one primary plate and the another one secondary plate enclose one of the second plate interspaces with a second flow volume, and the quotient between the first flow volume and the second flow volume is between 1.8 and 2.1.

* * * * *